US006997859B2

(12) United States Patent
Peacocke et al.

(10) Patent No.: US 6,997,859 B2
(45) Date of Patent: Feb. 14, 2006

(54) CENTRIFUGAL SEPARATOR WITH FLUID INJECTION OPENINGS FORMED IN A SEPARATE STRIP INSERT

(75) Inventors: Kevin Gordon Peacocke, Harare (ZW); Brett Robert Henry Knelson, Langley (CA); Victor James Bartsch, Abbottsford (CA); Edwin John William Zonneveld, Fort Langley (CA)

(73) Assignee: Knelson Patents Inc., Langley (CA)

( * ) Notice: Subject to any disclaimer, the term of this patent is extended or adjusted under 35 U.S.C. 154(b) by 54 days.

(21) Appl. No.: 10/694,867

(22) Filed: Oct. 29, 2003

(65) Prior Publication Data

US 2004/0132601 A1 Jul. 8, 2004

(51) Int. Cl.
*B04B 11/04* (2006.01)

(52) U.S. Cl. ..... 494/29; 494/80

(58) Field of Classification Search ..... 494/1, 494/5, 11, 23, 27–30, 63, 80, 36, 37, 56; 210/360.1, 380.1; 209/453
See application file for complete search history.

(56) References Cited

U.S. PATENT DOCUMENTS 459,197 A * 9/1891 Bodge ..... 210/365
459,858 A * 9/1891 Seymour ..... 494/47
489,101 A * 1/1893 Seymour ..... 209/199
556,567 A * 3/1896 Waring ..... 494/80
726,948 A * 5/1903 Land ..... 494/67
917,123 A * 4/1909 Peck ..... 494/29
957,478 A * 5/1910 Simpson ..... 494/30
980,001 A * 12/1910 Ponten ..... 494/35
981,679 A * 1/1911 Peck ..... 494/11
1,011,078 A * 12/1911 Peck ..... 494/11
1,012,097 A * 12/1911 Peck ..... 494/1
1,283,846 A * 11/1918 Mark et al. ..... 494/60
1,322,139 A * 11/1919 Schifferle ..... 494/28
1,473,421 A * 11/1923 Eccleston ..... 494/29
1,557,672 A * 10/1925 Doerner ..... 209/199
1,594,501 A * 8/1926 Eccleston ..... 494/29
1,599,502 A * 9/1926 Hermanus ..... 494/43
1,684,870 A * 9/1928 Lewis ..... 209/199
1,718,547 A * 6/1929 Eccleston ..... 494/29
1,750,860 A * 3/1930 Rawlings ..... 494/2
1,853,249 A * 4/1932 Ainlay ..... 494/43
1,882,389 A * 10/1932 Macisaac ..... 494/11
1,935,547 A * 11/1933 Dryhurst ..... 494/67

(Continued)

FOREIGN PATENT DOCUMENTS

AU 22055/35 4/1936

(Continued)

*Primary Examiner*—Charles E. Cooley
(74) *Attorney, Agent, or Firm*—Adrian D. Battison; Michael R. Williams; Ryan W. Dupuis

(57) ABSTRACT

A centrifuge concentrator bowl includes a plurality of fluidized recesses at axially spaced positions along the peripheral wall. Each recess is defined by two side walls converging toward a base which has water injection holes for fluidizing materials collecting in the recess. The volume within which collection occurs is defined by a replaceable plastic strip member across the recess spaced from the base so that a water channel is formed inside the bowl between the base of the recess and the strip. Water from the channel is injected through holes in the strip in a generally tangential direction around the recess. The use of the replaceable strip allows the injection openings of the bowl to be tailored to requirements and/or to be cleaned of scale by rapidly removing and replacing the strips in the bowl.

16 Claims, 6 Drawing Sheets

U.S. PATENT DOCUMENTS 1,988,500 A * 1/1935 Lack ..... 209/199
2,022,926 A * 12/1935 Schlank ..... 494/32
2,112,099 A * 3/1938 Ballou et al. ..... 494/67
2,132,195 A * 10/1938 Stirn ..... 494/80
2,161,476 A * 6/1939 Leja ..... 494/45
2,161,477 A * 6/1939 Leja ..... 209/422
2,179,807 A * 11/1939 Asmussen ..... 494/27
2,230,013 A * 1/1941 Pecker ..... 494/58
2,272,675 A * 2/1942 Knudsen ..... 494/45
2,472,475 A * 6/1949 Hamilton ..... 209/199
2,782,925 A * 2/1957 Morton ..... 494/27
3,152,074 A * 10/1964 Fontein et al. ..... 210/781
3,256,993 A * 6/1966 Werner et al. ..... 210/370
3,366,318 A * 1/1968 Steimel ..... 494/7
3,963,175 A * 6/1976 Daubman et al. ..... 494/74
4,279,741 A * 7/1981 Campbell ..... 209/44
4,286,748 A * 9/1981 Bailey ..... 494/29
4,361,480 A * 11/1982 Corbus et al. ..... 209/453
4,533,344 A * 8/1985 Gunnewig ..... 494/36
4,608,040 A * 8/1986 Knelson ..... 494/27
4,776,833 A * 10/1988 Knelson ..... 494/27
4,846,781 A * 7/1989 Knelson ..... 494/27
4,981,219 A * 1/1991 Burnell et al. ..... 209/453
4,983,156 A * 1/1991 Knelson ..... 494/28
5,087,127 A * 2/1992 Knelson ..... 494/37
5,222,933 A * 6/1993 Knelson et al. ..... 494/29
5,230,797 A * 7/1993 Knelson ..... 210/380.1
5,338,284 A * 8/1994 Knelson ..... 494/28
5,354,256 A * 10/1994 Knelson ..... 494/80
5,368,541 A * 11/1994 Knelson ..... 494/37
5,372,571 A * 12/1994 Knelson et al. ..... 494/29
5,421,806 A * 6/1995 Knelson et al. ..... 494/37
5,462,513 A * 10/1995 McAlister ..... 494/56
5,586,965 A * 12/1996 Knelson ..... 494/29
5,601,523 A * 2/1997 Knelson ..... 494/29
5,601,524 A * 2/1997 Knelson ..... 494/29
5,713,826 A * 2/1998 West ..... 494/45
5,728,039 A * 3/1998 Knelson ..... 494/29
5,895,345 A * 4/1999 Knelson ..... 494/29
6,095,965 A * 8/2000 Eiderman et al. ..... 494/80
6,149,572 A * 11/2000 Knelson ..... 494/37
6,796,934 B1 * 9/2004 McAlister et al. ..... 494/56
6,869,389 B1 * 3/2005 Mackel et al. ..... 494/36
2004/0121892 A1 * 6/2004 Zonneveld et al. ..... 494/67
2004/0132601 A1 * 7/2004 Peacocke et al. ..... 494/29
2005/0026766 A1 * 2/2005 Grewal ..... 494/29

FOREIGN PATENT DOCUMENTS

CA 2085064 6/1993
CA 2436496 * 12/2003
CA 2443239 A1 * 12/2003
CA 2443239 C * 3/2005
DE 2031350 * 12/1971
JP 58-24366 * 2/1983
JP 11-276110 * 10/1999

* cited by examiner

SECTION A-A

2) Multipoint profile

3) Triangular profile

4) Triple passage fluidization profile

5) Dome profile with alternate engagement location

CENTRIFUGAL SEPARATOR WITH FLUID INJECTION OPENINGS FORMED IN A SEPARATE STRIP INSERT

This invention relates to a centrifugal separator of the type having a plurality of axially spaced annular recesses on a peripheral wall of a rotatable bowl.

In U.S. Pat. Nos. 4,608,040, 4,776,833, 5,222,933, 5,421,806, 5,230,797 and 5,338,284 of Benjamin Knelson and now assigned to the present Assignee discloses a number of different arrangements of centrifugal separator of the type including a rotatable bowl having a peripheral wall of generally frusto-conical shape on which is provided a plurality of axially spaced, annular recesses. The particulate material containing fractions of different specific gravity to be separated is fed in slurry form through a feed duct to a position at or adjacent a base of the bowl so that the feed materials pass over the peripheral wall with heavier particulate materials collecting in the annular recesses while lighter particulate materials escape from the bowl through the open mouth. In the above patents, all of the annular recesses are fluidized by the injection of fluidizing water through holes in the peripheral wall at the respective recesses thus acting to fluidize the collecting material within the recesses.

A further arrangement is disclosed in U.S. Pat. No. 5,586,965, issued Dec. 24, 1996 of the above inventor in which the number of recesses is reduced and a frusto-conical lead-in section of the bowl is provided which is free from fluidized recesses so that the feed material is deposited onto the lead-in section and flows over that lead-in section prior to reaching the first annular recess.

In all cases the fluidized recesses are formed by providing drilled holes through the base of the recess in the manner disclosed in U.S. Pat. Nos. 4,608,040 and 5,230,797 above. This provides requirements on the construction and location of the holes which can lead to blockage and can limit the ability to tailor the arrangements to the best processing parameters.

In Australian Published Application 22,055/35 published 2nd Apr. 1935 by Macnicol is disclosed a centrifuge bowl where the recesses on the peripheral wall are fluidized by injecting water through the wall and where the holes through the wall are covered by a band of screen material applied on the inside surface of the wall. The purpose of this screen is not explained. This device has not achieved commercial success and the disclosure has been long abandoned as a workable arrangement.

In Canadian Patent Application 2,085,064 of the above inventor published 12$^{th}$ Jun. 1993 is disclosed an arrangement using the machine having conventional V-shaped recesses of the type disclosed in the above patents in which an annular insert of a screen mesh material is placed in each recess at a position spaced from the base of the recess and spaced from the mouth of the recess with the intention of forming a recess which is shallower than the conventional recess. The shallow recesses are intended to form a concentrate which is richer than that of a conventional concentrator since less material is collected in each recess and it is stated that the machine is intended to be used as a "final separator" in a process of repeated concentration. Thus the inventor intended that in a line of conventional separators, the last would be modified from the conventional by the addition the mesh material inserts to form the special shallow recesses for the last separator only.

SUMMARY OF THE INVENTION

It is one object of the present invention to provide an improved centrifugal separator of the above general type in which maintenance and operation of the system is significantly improved.

According to a first aspect of the invention, therefore, there is provided a centrifuge bowl for use in an apparatus for separating intermixed particulate materials of different specific gravity in a slurry where the apparatus includes a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in the recess at a position therein so as to define a channel between the side walls, inwardly of the base and outwardly of the strip member within which the fluidizing liquid from the liquid entry opening can flow within the recess;

each insert member having an inwardly facing surface which spans the space between the side walls at the strip member so as to confine the materials within the volume of the recess defined by the side walls and inwardly of the inwardly facing surface of the strip member;

each insert member being formed of an imperforate material having an array of fluid injection holes defined therethrough which allow the injection of jets of fluidizing liquid from the channel through the insert member into the volume.

Preferably each insert member is sufficiently thick so that each injection hole has a specified direction along an axis of the hole tending to direct the jet of fluidizing liquid in a direction along the axis of the hole. Such t thickness is preferably greater than 3/16 inch so as to provide the necessary directional effect.

Preferably the injection holes are smaller in transverse dimensions than the fluid entry openings. This allows the fluid injection openings to be larger than would be normally acceptable since they are not used to prevent the escape of material outwardly so that they can be large enough to remain clean and avoid blockages. On the other hand, the smaller fluid injection holes can be smaller but can readily be cleaned by temporarily taking out the insert and replacing it with a new clean insert or by readily cleaning the insert when removed.

Preferably the total area of the fluid entry openings is greater than the total area of the injection holes to retain a pressure behind the insert which inhibits the passage of fluid outwardly.

Preferably the side walls each include a shoulder onto into which an outer surface of the insert member engages.

Preferably each insert member has the side edges including one or more barbs arranged to engage into the side wall of the recess.

Preferably the side walls of each recess are molded from a resilient plastics material and wherein each insert member is formed from a material which is harder than the resilient plastics material so that the side edge thereof at the surface projects into the plastics material.

Preferably each insert member includes at least two rows and more preferably only two rows of holes at axially spaced positions across the width of the insert member.

Preferably each insert member has a projecting portion extending therefrom inwardly toward the axis and when the insert member includes at least two rows of holes at axially spaced positions across the width of the insert member the projecting portion is arranged between the rows.

Preferably some of the insert members are imperforate so as to prevent flow of liquid from the channel to the volume.

Preferably the insert members of alternate ones of the recesses are imperforate.

Preferably each recess from the insert member to the inner edge of the side walls of the recess has a depth greater than 1.0 inches and preferably greater than 2.0 inches.

Preferably each side wall of the recess from its point of contact with the surface of the insert member lies on an imaginary conical surface.

According to a second aspect of the invention there is provided a replacement insert member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

the bowl having a fluidizing liquid injection system for fluidizing the materials in each of the recesses including a liquid supply and at least one liquid entry opening extending from the supply into the recess at or closely adjacent the base of the recess;

the replacement insert member comprising an elongate insert body arranged to be mounted in a respective one of the recesses so as to define a channel between the side walls, inwardly of the base and outwardly of the insert member within which the fluidizing liquid from the liquid entry opening can flow around the recess;

the elongate insert body having an inwardly facing surface which is arranged to span the space between the side walls at the insert member so as to confine the materials within the volume of the recess defined by the side walls and inwardly of the surface of the insert member;

the insert body being formed of an imperforate material having an array of fluid injection holes defined therethrough which allow the injection of jets of fluidizing liquid.

Preferably the fluid injection holes lie at an angle to a line at right angles to the surface of the strip member so as to tend to cause movement of the injected liquid in a direction around the recess, in what is generally know as "tangential injection". However other arrangements and orientations of the holes can be provided for specific end uses in view of the ready replaceablilty of the strip in the bowl. In particular the strip may be formed with holes which are merely at right angles to the surface of the strip and thus extend generally radially inwardly of the bowl. In this instance, the strip may be relatively thin and formed of a more rigid material such as metal, so that a thickness of the order of 1/16 inch might be suitable.

Preferably one or more of the strip members of selected ones of the recesses are imperforate so as to prevent flow of liquid from the channel to the volume. In this case one possible arrangement is that alternate ones of the recesses are imperforate.

Preferably each recess is shaped to define radially inwardly facing shoulder against which an outer surface of the strip member rests to prevent radially outward movement of the strip member into the channel.

Preferably each side wall of the recess from its point of contact with the surface of the strip member lies on an imaginary conical surface.

According to a second aspect of the invention, for use as a spare or replaceable part, there is provided a replacement strip member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

the bowl having a fluidizing liquid injection system for fluidizing the materials in each of the recesses including a liquid supply and at least one liquid entry opening extending from the supply into the recess at or closely adjacent the base of the recess;

the replacement strip member comprising an elongate strip body arranged to be mounted in a respective one of the recesses at a position therein spaced from the base of the recess so as to define a channel between the side walls, inwardly of the base and outwardly of the strip member within which the fluidizing liquid from the liquid entry opening can flow around the recess;

the elongate strip body having an inwardly facing surface which is arranged to span the space between the side walls at the strip member so as to confine the materials within the volume of the recess defined by the side walls and inwardly of the surface of the strip member;

and the elongate strip body having an array of fluid injection holes therein which allow the passage of fluidizing liquid from the channel through the strip into the volume.

BRIEF DESCRIPTION OF THE DRAWINGS

One embodiment of the invention will now be described in conjunction with the accompanying drawings in which.

DETAILED DESCRIPTION

Figure 1:
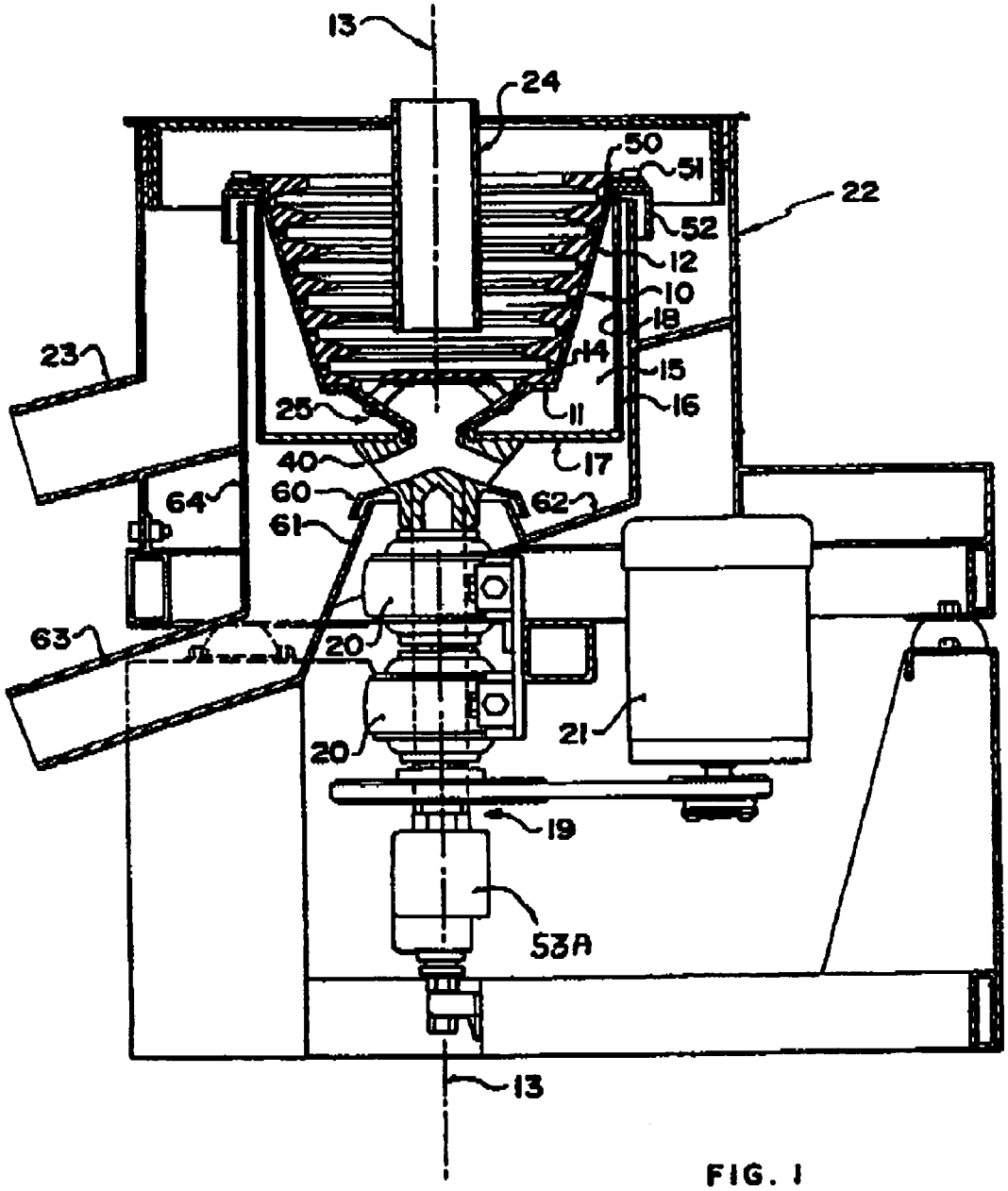
FIG. 1 is vertical cross sectional view through a first embodiment of centrifugal separator according to the present invention.

The general arrangement of the centrifugal separator shown in FIG. 1 is taken from the above U.S. Pat. No. 5,222,933 of the present inventor and therefore will described only briefly in regard to the points of importance. The disclosure of the above patents of the present inventor may be referred to for further details which may be necessary for a full understanding.

The apparatus therefore comprising a bowl generally indicated at 10 having a base generally indicated at 11 and a peripheral wall 12 standing upwardly from the base to an open mouth 13. The bowl can rotate around an axis 15 on a support shaft 16.

A feed duct 17 carries feed materials 18 in the form of a mixture of heavier and lighter particulate materials in a water slurry through the open mouth to a position adjacent to the base so the feed materials can be deposited onto a horizontal guide plate 11A at the base 11 and can move therefrom onto the peripheral wall 12 for separation of the heavier materials into a plurality of recesses 19 on the peripheral wall while the lighter materials in the slurry pass over the peripheral wall to the open mouth for discharge. The recesses are annular and are axially spaced. The peripheral wall is frusto-conical so that the diameter of the recesses increases from a first recess at the base to a last recess at the open mouth. Material exiting from the open mouth is collected by a launder 20 for discharge.

Around the bowl 10 is provided a jacket 21 having a peripheral wall 22 and a base 23 both of which are connected to the respective elements of the bowl so as to form a compartment 21A fed with fluidizing water from a central duct 24 of the shaft 16 through connecting ducts (not shown). The compartment 21A therefore receives fluidizing water under pressure which is communicated through openings 25 in the peripheral wall 12 into the recesses for adding fluidizing water into the material collecting in the recesses.

The separation and collection process is a batch process so that the heavier material is collected in the recesses for subsequent wash down and collection. The collected materials when washed down to the base pass through a discharge opening 26 into a second collection system 27 for collecting the concentrate.

The feed duct 17 comprises a cylindrical tube carried on a cover 28 of the launder 20. Thus the tube forming the feed duct is in fixed position and remains stationary as the bowl rotates around the axis 15.

Figures 3, 4:
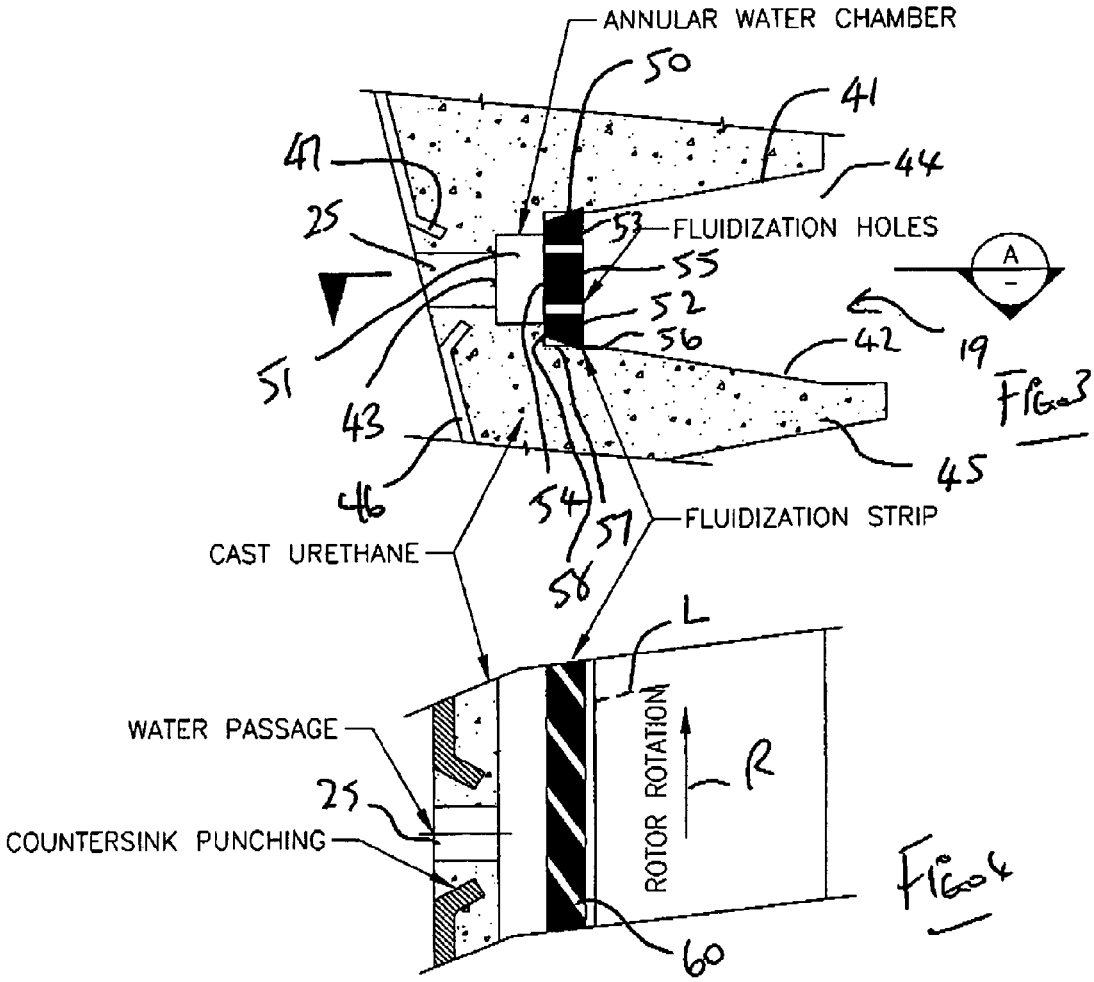
FIG. 3 is a cross sectional view in an axial plane through the bowl only of the apparatus according to the present invention showing the details of the insert member in one recess.
FIG. 4 is a cross sectional view taken along the lines 4—4 of FIG. 3.

The recesses 19 are generally of the type previously described in earlier patents and include, as shown in FIG. 3, side walls 41 and 42 which converge generally outwardly from the axis toward a base 43 of the recess which is narrower than an open mouth 44 of the recess. The base 43 has a width sufficient so that the holes 25 pass through the peripheral wall of the bowl into the base so that the fluidizing water in the compartment 21A can pass through the holes 25 to fluidize the materials within the recess 19.

As described in detail in the above U.S. Pat. No. 4,776,833, the recesses are formed by molding a resilient liner material 45 on the inside surface of the bowl. Thus the bowl is structurally formed from a metal wall 46 which is generally frusto conical onto the inside surface of which is molded the liner including the recesses. The lining material is generally a resilient plastics material such as urethane which is resistant to wear since it can flex under the impact under the materials. The holes 25 are formed through the wall 46 by punching a first opening 47 and then by drilling through the lining material into the base 43.

The present invention is modified relative to the previous patents in that an additional strip member or insert member 50 is added which is supported in the recess at a position spaced radially inwardly from the base 43 to define a channel 51 between the base 43, inwardly of the side walls 41 and 42 and outside of the strip member 50.

The strip member 50 has side edges 52 and 53 which are chamfered or tapered so that the rear surface 54 of the strip member is narrower than the front surface 55 of the strip member. This also defines sharpened or chamfered side edges 56 at the front surface 55 so as to engage into or bite into the side walls 41 and 42 when the strip is pressed into the recess toward the base 43.

In order to receive the strip member, the side walls at the point of location of the strip member are formed to define a first channel 57 with parallel side walls which are slightly wider than the side walls of the channel 51 to form a shoulder 58 against which the rear surface 54 of the strip member abuts. Thus the strip member can be pressed into the recess until the rear surface butts against the shoulder 58 whereupon the chamfered edge 56 bites into the side walls 41 and 42 respectively to form a recessed or compressed shoulder at the side edges 56 which hold the strip member against the shoulder 58.

The strip member is formed of a suitable material such as a hard plastics material which provides it with sufficient transverse rigidity so that it is held against bending in the transverse direction so that the front surface 55 remains flat with the edges 56 biting into the side walls of the recess.

The strip member is relatively thick having a thickness in the range 3/16 to 3/8 inch that is 0.1875 to 0.375 inch (4.7 to 9.5 mms) so it is relatively stiff and so as to provide sufficient thickness to define channels in the strip member defining injection holes 60. As shown in FIG. 4, the channels or injections holes 60 are arranged at an angle to a line L at right angles to the surface 55 so as to tend to inject the liquid along the recess in an angular direction around the recess and in a direction opposite to the direction of bowl rotation indicated at R. The holes or injection openings preferably lie in a radial plane of the axis so that the injection water tends to rotate around the axis without any moment of movement in the axial direction. In the example shown there are two rows of holes through the strip member with each row communicating with the channel behind the strip member although this number of holes may be increased or decreased so that there is a single row or more than one row as required. The above thickness is preferred for the strip having holes at an angle to the surface so as to generate holes with a tendency to cause flow around the bowl. However some uses may not require such angled holes so that the strip may be thinner as its thickness is only determined by the necessary strength rather than any requirement to direct water flow. The present arrangement has the advantage of allowing ready replacement of strips so that hole configuration can be readily changed. This thickness is significantly greater than that of conventional mesh and the holes are arranged in what is otherwise, apart from the holes, an imperforate material. Thus the holes define individual channels so that the flow can be determined and directed as opposed to a mesh which merely allows the flow to diffuse through into the material inwardly of the mesh.

The diameter of the injection holes 60 is relatively small as described hereinafter and significantly less in diameter than the size of the holes 25. The total hole area of the holes 25 is arranged to be greater than the total area of the holes 60 so that the water within the channel 51 is pressurized to generate a flow through the openings 60 in the radially inwardly direction despite high pressures within the volumes of the recess inside the surface 55 of the strip member which are caused by the high centrifugal forces generated by rotation of the bowl. The holes 60 are relatively small so as to restrict or inhibit the reverse flow of any particles. The holes are relatively small so as to provide a large array of holes which can generate fluidization over a relatively large area within the volume of the recess inside the surface 55.

The strip is preferably a continuous strip having a length equal to the circumference of the recess at the location where the strip is to be located so that the strip can be pressed into place with the ends of the strip butting when under slight pressure. The ends are maintained butting by the engagement with the side walls of the recess so as to prevent the ends from slipping out of place and allowing the strip to collapse radially inwardly under pressures from the fluid in the channel 51.

The side walls of the recess are generally conical from the inside surface 55 radially inwardly so as to form generally V shaped recess with the base of the recess forming the volume within which material is to be collected defined by the surface 55 of the strip member.

Figure 2:
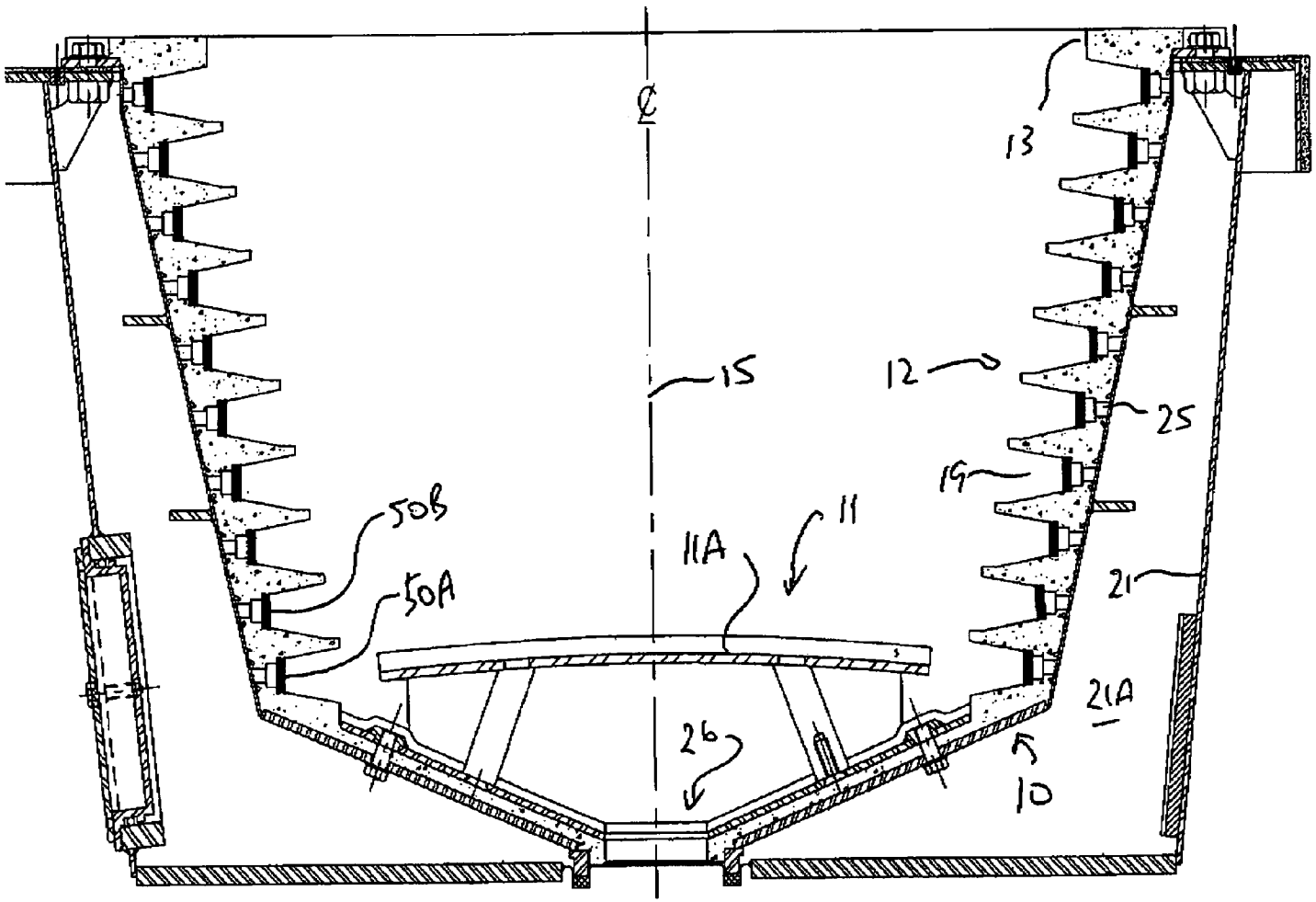
FIG. 2 is a cross sectional view through a part of the bowl only of FIG. 1 on an enlarged scale.

In FIG. 2, some of the strip members indicated at 50A are imperforate so that no fluid flows inwardly and some are perforated with the holes 60 as previously described as indicated at 50B. It will be appreciated that, as the strip members can be readily removed and replaced, it is possible to select certain arrangements of perforated and imperforated strip members for a particular effect within the bowl as shown in FIG. 2.

The arrangement described herein thus provides a removable plastic strip that when in place, creates the back or base of the concentrating ring and contains the fluidization holes. When in place, the strip creates a small water cavity behind itself through which water travels around the periphery of the strip to supply the fluidization holes in the strip. The strip thus now be drilled as required for a specific application and then changed out with a different pattern as required. The small water chamber behind the strip is supplied with water via a multitude of fairly large (¼"–⅜" diameter) holes that transfer water from the main water cavity formed between the concentrating cone wall and the exterior water jacket.

The plastic strip is simply pushed into a slot in the urethane, with edge "barbs" locking it into the slot since the plastic selected is hard and the urethane is relatively soft and providing an effective interference-fit. The side edges of the strip are preferably tapered or chamfered thus providing a sharp barb at the inside surface which engages as a sharp edge into the urethane and locks the strip in place. In addition the annular shape of the strip and its butting ends means that the strip provides hoop strength and has to collapse inwards against itself and deform the circle if it is to push out of the engagement slot under inward pressure from the water behind the strip. Also in operation such inward collapsing will have to overcome the centripetal forces generated by rotation when the machine is operating. The strip starts out as a flat strip and is installed into the ring as a band, with the one or more joint(s) where the ends meet simply butting up against each other. In place of a butt joint, there may be provided a wedge driven between the ends radially outwardly to press the ends apart and thus close any small gaps at the joints. The joints do not need to be water tight as they will only leak a small amount of water, if any, and this will leak in a direction radially inwardly due to the higher water pressure in the channel than in the inner volume of the recess. Such inwardly flowing water is intended in any event as the process is adding water to the concentrating recess as part of the process, with the only disadvantage of such leaks being that the amount of water passing through the intended holes is reduced.

In addition it is desirable to select a plastics material from those readily available to one skilled in the art which will expand slightly as it absorbs water, thus tightening itself further into its installed position and applying pressure at the joints where the strip ends meet.

It is desirable, when installed, for the strip to create the same ring shape and operational characteristics as the construction shown and used in the above patents such that it operates with the same characteristics. However the strip can be readily removed and replaced by strips having a variety of different fluidization hole patterns and hole sizes as described above, so as to quickly and simply allow modification of the operating characteristics.

Alternately, certain ones of the strips in the recesses can be installed with no holes to create no water flow, allowing the respective recess to pack with solids and create blanked out recesses. The use of such imperforate strips can be used alternately with perforated strips to simulate the arrangement shown in U.S. Pat. No. 5,895,345 above. This would have the added benefit of these blanked out recesses being "autogenous" wear recesses, that is, the material packed in the recess creates the blanked out area instead of urethane doing this, providing a self-replacing wear component formed from the process materials themselves rather than from a manufactured item so that the wear on the manufactured item is much reduced allowing a much longer wear life than would be the same product manufactured wholly from urethane as is conventional. The recesses which contain the imperforate strip do not flush out during a flush cycle, other than perhaps at the very innermost surface in view of the fact that the materials are impacted and there is no injected liquid to maintain or cause the required fluidization for flushing.

The main benefits of the removable strips are:

1) As the fluidization holes clog from scale build-up, which is quite prevalent in many mines, the strips can be easily pulled out and replaced with a new one without needing to remove the concentrating cone for hole cleaning as is currently the case. The machine is shut down for much less maintenance time and the old clogged strip can be cleaned at a later time if it is otherwise in good condition or replaced if the customer prefers.

2) The strips provide a simple means of changing drill patterns and hole sizes. Currently this can only be done by stripping the urethane, casting a new urethane lining and drilling the desired pattern which is obviously more expensive.

3) A cone can be configured in the field for different applications with different arrangements of perforated and imperforate.

This provides a major benefit as the current maintenance in many mines requires the bowl to be removed for cleaning every few days, requiring the machine to be off-line for a couple of hours if they have a spare bowl to replace or a good 4–6 hours if the bowl must be cleaned before it can be reinstalled and machine can be put back in service. The holes that transfer water into the water chamber behind the strip can be much larger and will not require cleaning for a much longer period, if at all. The fluidization holes are typically very small (~1/32"–1/16" diameter) and have water traveling through at fairly high velocities, the combination of which is the perfect environment for calcium carbonate scale creation. The 1/4"–3/8" holes which can be used to inject into the channel behind the strip are much less of a problem and can plug up much of their volume before they will affect water flow capacity to the channel and thus through the strip.

The insert member is formed from a strip of material which is of itself imperforate and has formed into it a plurality of hates which can be formed preferably by drilling since this generates holes which are cylindrical, but other techniques such as punching can be used. The holes are discrete and individually formed. The material can be formed into the required shape to form the strip by cutting of a sheet or the strip can be formed by extrusion. The simpler shapes described herein are preferably formed by cutting but it will be appreciated that extrusion of a suitable relatively stiff plastics material is preferred to form the more complex shapes of FIGS. 5 to 9. After extrusion of the basic shape, the holes are drilled in the required pattern to form the required number of rows or the required array and at the required angle to the radial plane and to the axial plane.

The thickness of the insert member 50 is such that the holes formed therethrough have a sufficient length through the thickness that they tend to define a stream of liquid or a jet of liquid passing through the insert member extending along an axis of the hole or opening formed through the insert member. As shown in FIG. 3, there are two rows of the holes at positions spaced across the width of the insert member with the holes being equidistantly spaced from the side walls of the recess. This leaves an open area between the holes. The holes lie in a radial plane of the bowl axis but are inclined as shown in FIG. 4 within that radial plane so as to tend to inject the jet of liquid in a direction around the bowl opposite to the direction of rotation of the bowl.

In FIG. 3 the insert member forms a simple strip of constant width and constant thickness across its width. The rear surface of the strip sits against the shoulder 58 and the barb defined by the front edge 56 of the side of the strip engages into the side wall of the recess due to the difference in hardness between the insert member and the resilient side wall.

Figure 5:
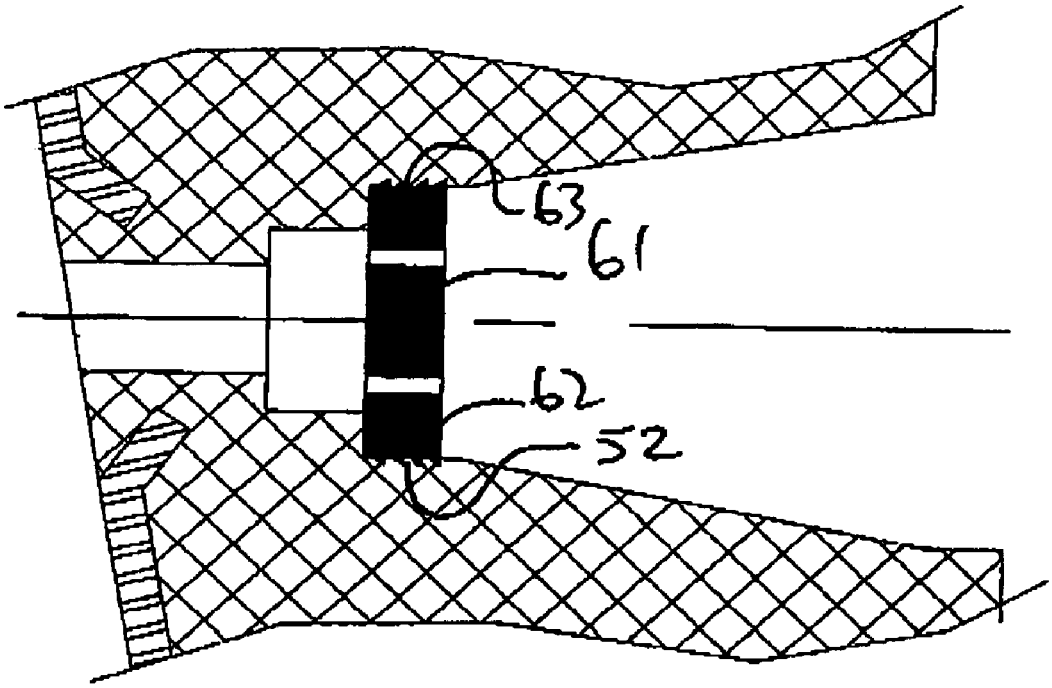
FIGS. 5, 6, 7 and 8 are cross-sectional views similar to that of FIG. 3 showing modified embodiments of the insert member.

In FIG. 5 the insert member 61 is formed with a plurality of barbs 62 on its side surface 63. Thus instead of being tapered as shown in FIG. 3, a series of tapered barbs is formed on the side surface. The recess has a radial section 57 which engages the barbs 62 with the rear surface of the insert member sitting against the shoulder as previously described. The additional barbs assist in holding the insert member in place within the recess at the base of the recess against the shoulder.

Figure 6:
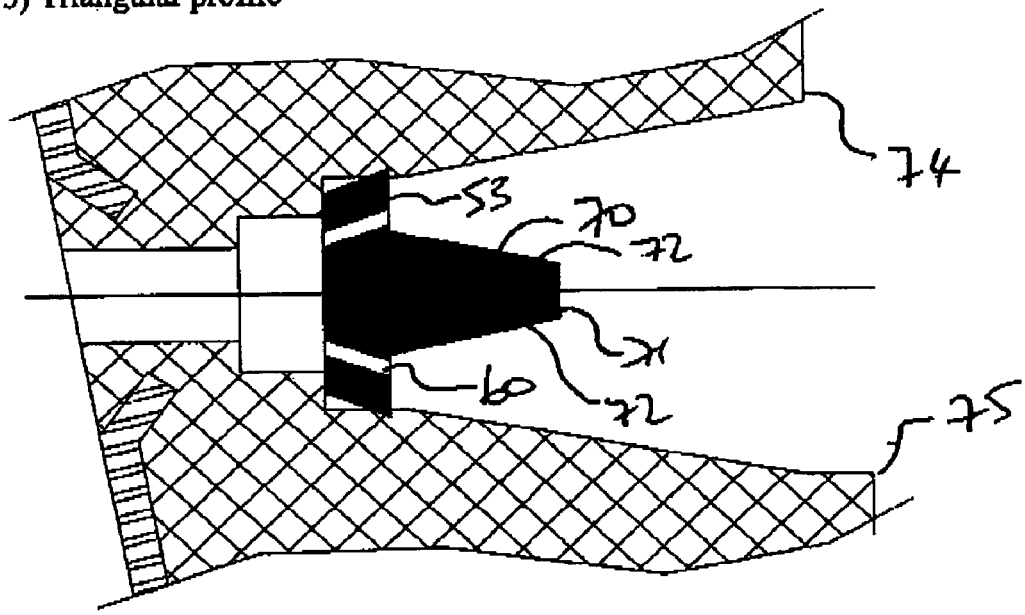

In FIG. 6 is shown an alternative modification to the insert member of FIG. 3. In this embodiment the strip forming the insert member has an additional inwardly projecting portion 70 formed on the front face 55 of the insert member and between the holes 60. In this embodiment the holes 60 are inclined to the radial plane of the bowl axis so that in the cross section shown in FIG. 6, the axis of each hole tends to extend from the channel behind the insert generally along the respective side wall of the recess or slightly toward the side wall so as to inject the fluid at an angle to the radial plane. This angle of the holes 60 provides a wider area of the front surface 55 between the outlet of the holes on the recess side of the insert member thus providing a wider base for the projection 70. The projection 70 forms a rib extending around the recess and projecting into the recess. The rib is tapered so that a front surface 71 of the rib is narrower than the area at the base of the rib between the base of the holes 60. Thus the side walls 72 of the rib taper inwardly toward the front surface 71. The rib or projection 70 thus reduces the volume of the recess in front of the front surface 55 and behind the outside edges 74 and 75 of the recess.

The depth of the recess from the edges 74 and 75 to the front surface 55 is of the conventional dimensions used in centrifugal separators of this general type and is not reduced by mounting the insert close to the edges 74 and 75. Thus the insert forms what would normally be in effect the base of the recess so that the depth of the recess is generally greater than 1.0 inches and preferably greater than 2.0 inches. This provides a volume of the recess which is sufficient to receive relatively large quantity of the concentrate thus ensuring collection of the heavier particles within the concentrate from a relatively large batch of the material passed through the bowl. In cases where it is desirable to reduce the volume slightly, the rib 70 is provided which reduces the volume by approximately 10–25%.

Figure 7:
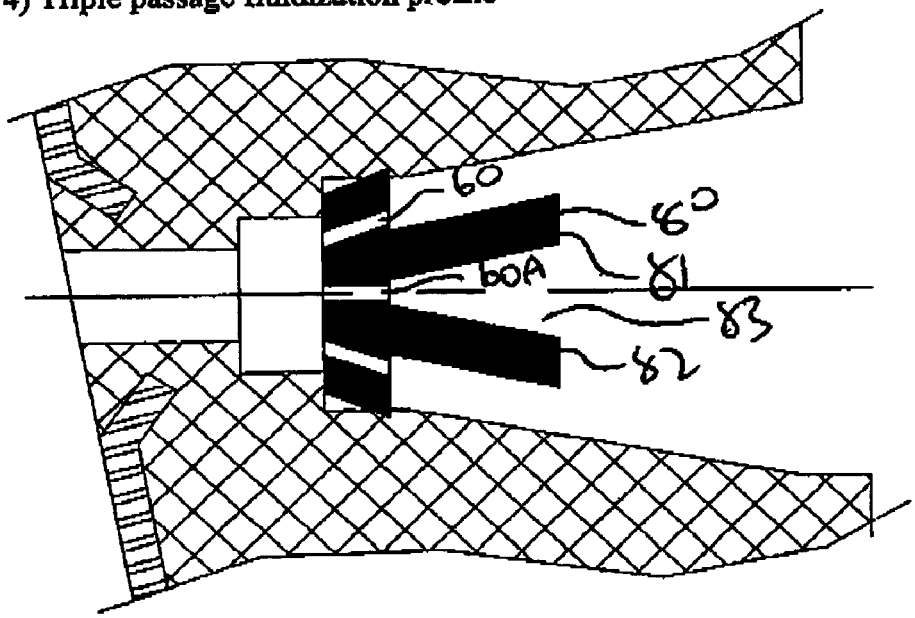

A further alternative arrangement is shown in FIG. 7 where a modified projection 80 is provided which is defined in two rib sections 81 and 82 with a recess 83 between them. In this embodiment there are three rows of holes 60 in the insert member including a centre row 60A located between the two portions 81 and 82 of the projection 80. The arrangement shown in FIG. 7 increases the amount of fluid injected through the insert and yet provides a volume reduction in the recess as previously described.

Figure 8:
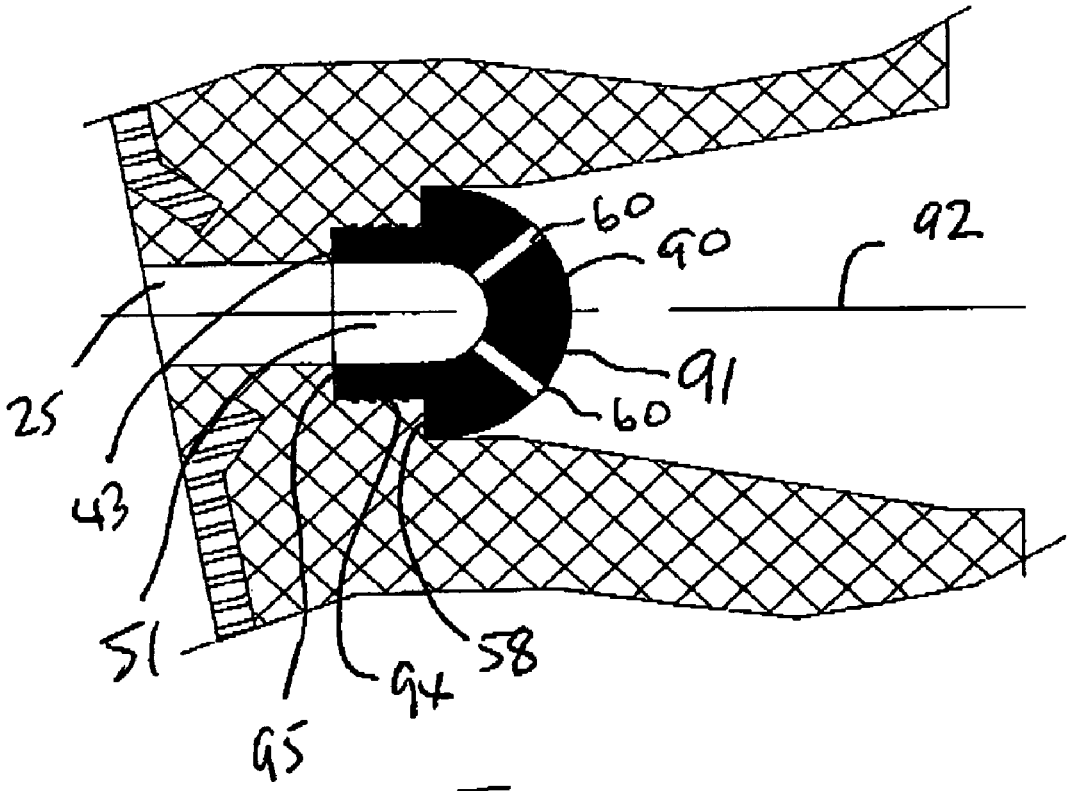

In FIG. 8 is shown a yet further modified insert member 90 which has a semi-cylindrical outside surface 91 through which the holes 60 emerge. The holes 60 extend along a radius of the centre of the semi-cylindrical surface 91 so that their direction is at an angle of the order of 20–30 degrees relative to the radial plane 92. Thus each of the two rows of holes is directed against the respective side surface of the recess so that the fluid injected through the respective holes 60 forms a stream or jet from the hole which impinges upon the side wall of the recess. An additional row of holes can be provided on the radial plane 92.

A further modification in this embodiment is that the barbs 94 which hold the insert member in place are arranged to engage the sides of the recess below the shoulder 58. In this embodiment therefore the insert member has a base 95 sitting against the surface 43 at the bottom of the recess and outwardly of the shoulder 58. Thus in this embodiment the channel 51 is defined substantially within the insert member itself rather than within the recess. Thus the sides and outside surface of the channel 51 are formed by the insert member with only the base of the recess at the surface 43 forming part of the channel 51. The holes 25 are dimensioned so that they emerge within the channel 51 so as to inject the fluid through the large openings 25 into the channel 51.

In all embodiments the holes 25 are relatively large and of a dimension which is very much greater than could be tolerated if the particulate material were able to engage the holes 25 themselves. However of course the holes formed in the insert member constitute the hole injecting fluid into the recess and therefore these holes generally have a much smaller diameter than the relatively large holes to the channel 51. The holes through the insert member may be of a much larger number in total but the total area of the holes 25 is greater than the total area of the injection hole 60 so that more fluid flows into the channel than can escape thus acting to pressurize the fluid within the channel.

The invention claimed is:

1. A centrifuge bawl for use in an apparatus for separating intermixed particulate materials of different specific gravity in a slurry where the apparatus includes a feed duct far feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in its respective recess at a position therein so as to define a channel between the side walls, inwardly of the base of the recess and outwardly of the insert member within which the fluidizing liquid from the liquid entry opening can flow within the recess;

each insert member having an inwardly facing surface which spans the space between the side walls at the insert member so as to confine the materials within the volume of the recess defined by the side walls and inwardly of the inwardly facing surface of the insert member;

each insert member being formed of a material which is not a mesh so that the material is imperforate;

which imperforate material has an array of fluid injection holes formed through the imperforate material shaped and arranged to cause the injection of jets of fluidizing liquid from the channel through the holes in the insert member into the volume.

2. The bowl according to claim 1 wherein the injection holes are smaller in transverse dimensions than the fluid entry openings.

3. The bowl according to claim 1 wherein each insert member has a projecting portion extending therefrom inwardly toward the axis.

4. The bowl according to claim 3 wherein each insert member includes at least two rows of holes at axially spaced positions across the width of the insert member and wherein the projecting portion is arranged between the rows.

5. The bowl according to claim 1 wherein there is provided at least one imperforate insert member; the at least one imperforate insert member being mounted in a respective recess at a position therein so as to define a channel between the side walls, inwardly of the base of the recess and outwardly of the insert member within which the fluidizing liquid from the liquid entry opening can flow within the recess; the at least one imperforate insert member having an inwardly facing surface which spans the space between the side walls at the imperforate insert member so as to confine the materials within the volume of the recess defined by the side walls and inwardly of the inwardly facing surface of the imperforate insert member; the at least one imperforate insert member being arranged so as to prevent flow of liquid from the channel to the volume.

6. The bowl according to claim 5 wherein the insert members of alternate ones of the recesses are imperforate.

7. A centrifuge bowl for use in an apparatus for separating intermixed particulate materials of different specific gravity in a slurry where the apparatus includes a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in its respective recess at a position therein so as to define a channel between the side walls, inwardly of the base of the recess and outwardly of the insert member within which the fluidizing liquid from the liquid entry opening can flow within the recess;

each insert member having an inwardly facing surface which spans the space between the side wells at the insert member so as to confine the materials within the volume of the recess defined by the side walls and inwardly of the inwardly facing surface of the insert member;

each insert member having an array of fluid injection holes defined therethrough shaped and arranged to cause the injection of jets of fluidizing liquid from the channel through the insert member into the volume;

wherein each insert member is sufficiently thick so that at least some of the injection holes have a specified direction along an axis of the hole tending to direct the jet of fluidizing liquid in a direction along the axis of the hole;

and wherein said at least some of the holes are formed such that the axis thereof lies on a direction which is different from a line radial to the axis of the bowl.

8. A centrifuge bowl for use in an apparatus for separating intermixed particulate materials of different specific gravity in a slurry where the apparatus includes a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in its respective recess at a position therein so as to define a channel between the side walls, inwardly of the base of the recess and outwardly of the insert member within which the fluidizing liquid from the liquid entry opening can flow within the recess;

each insert member having an inwardly facing surface which spans the space between the side walls at the insert member so as to confine the materials within the volume of the recess defined by the side walls and inwardly of the inwardly facing surface of the insert member;

each insert member having an arry of fluid injection holes defined therethrough shaped and arranged to cause the injection of jets of fluidizing liquid from the channel through the insert member into the volume;

wherein the total area of the fluid entry openings is greater than the total area of the injection holes.

9. A centrifuge bowl for use in an apparatus for separating intermixed particulate materials of different specific gravity in a slurry where the apparatus includes a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in its respective recess at a position therein so as to define a channel between the side walls, inwardly of the base of the recess and outwardly of the insert member within which the fluidizing liquid from the liquid entry opening can flow within the recess;

each insert member having an inwardly facing surface which spans the space between the side walls at the insert member so as to confine the materials within the volume of the recess defined by the side walls and inwardly of the inwardly facing surface of the insert member;

each insert member having an array of fluid injection holes defined therethrough shaped and arranged to cause the injection of jets of fluidizing liquid from the channel through the insert member into the volume;

wherein the side walls of each recess each include a shoulder spaced from the base of the recess and formed in the side wall and facing generally radially inwardly of the bowl toward the axis of the bowl onto into which an an outwardly facing surface of the insert member engages to support the insert member against movement radially outwardly of the bowl.

10. The bowl according to claim 9 wherein each insert member has the side edges including one or more barbs arranged to engage into the side wall of the recess at the shoulder therein.

11. A replacement insert member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

the bowl having a fluidizing liquid injection system for fluidizing the materials in each of the recesses including a liquid supply and at least one liquid entry opening extending from the supply into the recess at or closely adjacent the base of the recess;

the replacement insert member comprising an elongate insert body arranged to be mounted in a respective one of the recesses so as to define a channel between the side walls, inwardly of the base and outwardly of the insert member within which the fluidizing liquid from the liquid entry opening can flow around the recess;

the elongate insert body having an inwardly facing surface which is arranged to span the space between the side walls at the insert member so as to confine the materials within the volume of the recess defined by the side walls and inwardly of the inwardly facing surface of the insert member;

each insert member being formed of a material which is not a mesh so that the material is imperforate;

which imperforate material has an array of fluid injection holes formed through the imperforate material shaped and arranged to cause the injection of jets of fluidizing liquid from the channel through the holes in the insert member into the volume.

12. The insert member according to claim 11 wherein the insert body has a projecting portion arranged to extend therefrom inwardly toward the axis.

13. The insert member according to claim 12 wherein the insert body includes at least two rows of holes at axially spaced positions across the width of the insert member and wherein the projecting portion is arranged between the rows.

14. A replacement insert member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

the bowl having a fluidizing liquid injection system for fluidizing the materials in each of the recesses including a liquid supply and at least one liquid entry opening extending from the supply into the recess at or closely adjacent the base of the recess;

the replacement insert member comprising an elongate insert body arranged to be mounted in a respective one of the recesses so as to define a channel between the side walls, inwardly of the base and outwardly of the insert member within which the fluidizing liquid from the liquid entry opening can flow around the recess;

the elongate insert body having an inwardly facing surface which is arranged to span the space between the side walls at the insert member so as to confine the materials within the volume of the recess defined by the side walls and inwardly of the inwardly facing surface of the insert member;

the insert body having an array of fluid injection holes shaped and arranged to cause the injection of jets of fluidizing liquid from the channel through the holes in the insert member into the volume;

wherein the insert body is sufficiently thick so that at least some of the injection holes have a specified direction along an axis of the hole tending to direct the jet of fluidizing liquid in a direction along the axis of the hole;

and wherein said at least some of the holes are formed such that the axis thereof, when the insert body is located in the bowl, lies on a direction which is different from a line radial to the axis of the bowl.

15. A replacement insert member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

the bowl having a fluidizing liquid injection system for fluidizing the materials in each of the recesses including a liquid supply and at least one liquid entry opening extending from the supply into the recess at or closely adjacent the base of the recess;

the replacement insert member comprising an elongate insert body arranged to be mounted in a respective one of the recesses so as to define a channel between the side walls, inwardly of the base and outwardly of the insert member within which the fluidizing liquid from the liquid entry opening can flow around the recess;

the elongate insert body having an inwardly facing surface which is arranged to span the space between the side walls at the insert member so as to confine the materials within the volume of the recess defined by the side walls and inwardly of the inwardly facing surface of the insert member;

the insert body having an arry of fluid injection holes shaped and arranged to cause the injection of jets of fluidizing liquid from the channel through the holes in the insert member into the volume;

wherein the insert body has side edges thereof each including one or more barbs arranged to engage into the side wall of the recess.

16. A centrifuge bowl for use in an apparatus for separating intermixed particulate materials of different specific gravity in a slurry where the apparatus includes a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass, when fed from the supply duct, so that the heavier particulate materials collect in the recesses;

each recess being defined by two recess side walls extending generally outwardly from the axis from an open mouth of the recess toward a base of the recess at the peripheral wall and converging toward one another;

a fluidizing liquid injection system for fluidizing the materials in each of the recesses including a liquid supply and at least one liquid entry opening extending from the supply into the recess at or closely adjacent the base of the recess;

and a plurality of removable insert members each mounted in a respective one of the recesses;

each insert member being mounted in its respective recess at a position therein so as to define a channel between the side walls, inwardly of the base of the recess and outwardly of the insert member within which the fluidizing liquid from the liquid entry opening can flow within the recess;

each insert member having an inwardly facing surface which spans the space between the side walls at the insert member so as to confine the materials within the volume of the recess defined by the side walls and inwardly of the inwardly facing surface of the insert member;

each insert member having an array of fluid injection holes defined therethrough which allow the injection of jets of fluidizing liquid from the channel through the insert member into the volume;

wherein each insert member has the side edges including one or more barbs arranged to engage into the side wall of the recess.

* * * * *